US010928121B1

(12) United States Patent
Robinson

(10) Patent No.: US 10,928,121 B1
(45) Date of Patent: Feb. 23, 2021

(54) SMART REFRIGERATOR

(71) Applicant: Keenan DeMarcus Robinson, Stafford, VA (US)

(72) Inventor: Keenan DeMarcus Robinson, Stafford, VA (US)

( * ) Notice: Subject to any disclaimer, the term of this patent is extended or adjusted under 35 U.S.C. 154(b) by 0 days.

(21) Appl. No.: 16/934,666

(22) Filed: Jul. 21, 2020

(51) Int. Cl.

| | |
|---|---|
| ***F25D 23/12*** | (2006.01) |
| ***F25D 29/00*** | (2006.01) |
| ***F25D 23/02*** | (2006.01) |
| ***F25C 5/20*** | (2018.01) |
| ***B67D 1/00*** | (2006.01) |
| ***F25D 25/00*** | (2006.01) |

(52) U.S. Cl.
CPC ..... *F25D 23/126* (2013.01); *B67D 1/0015* (2013.01); *F25C 5/22* (2018.01); *F25D 23/028* (2013.01); *F25D 25/005* (2013.01); *F25D 29/00* (2013.01); *B67D 2210/00036* (2013.01); *F25D 2400/361* (2013.01)

(58) Field of Classification Search
CPC ..... F23D 23/12; F25D 23/126; F25D 23/028; F25D 29/00; F25D 2400/361; F25C 5/22; B67D 2210/00036; B67D 1/0021; A23G 9/045; A23G 9/42
See application file for complete search history.

(56) References Cited

U.S. PATENT DOCUMENTS

| | | | | |
|---|---|---|---|---|
| 9,074,806 | B2 | 7/2015 | Cheon | |
| 9,279,611 | B2 | 3/2016 | Tan | |
| 2012/0102993 | A1* | 5/2012 | Hortin | B67D 1/0888 62/189 |
| 2015/0054395 | A1* | 2/2015 | Arslankiray | F25D 25/025 312/404 |
| 2016/0255983 | A1* | 9/2016 | Barquin | A47J 19/06 |
| 2018/0354773 | A1* | 12/2018 | Cronin | A23L 2/385 |
| 2020/0252705 | A1* | 8/2020 | Kwon | H04R 1/04 |

FOREIGN PATENT DOCUMENTS

| | | | | |
|---|---|---|---|---|
| WO | WO-2006007922 | A2 * | 1/2006 | A23G 9/48 |
| WO | WO-2009069957 | A1 * | 6/2009 | F25D 29/005 |

* cited by examiner

*Primary Examiner* — Marc E Norman
*Assistant Examiner* — Schyker S Sanks
(74) *Attorney, Agent, or Firm* — Sanchelima & Associates, P.A.; Christian Sanchelima; Jesus Sanchelima

(57) ABSTRACT

A system for a smart refrigerator including a refrigerator assembly, ice assembly, produce assembly and beverage mixer assembly is disclosed. The refrigerator assembly includes a refrigerator having storage compartments for perishable goods. The refrigerator further includes an ice compartment for the ice assembly and a produce compartment for the produce assembly. The beverage mixer assembly is also stored within the refrigerator. Displays are provided on the refrigerator for communication and education of the users. The ice assembly includes an ice maker to provide ice to a mixer of the beverage mixer assembly. The produce assembly includes produce containers storing the needed produce for the desired drinks and provides the produce to the mixer. The ice cubes and produce are processed, and a beverage is provided to the user with the beverage mixer assembly. Dieting is facilitated for users as healthy food options become readily available with the smart refrigerator.

19 Claims, 6 Drawing Sheets

SMART REFRIGERATOR

BACKGROUND OF THE INVENTION

1. Field of the Invention

The present invention relates to a smart refrigerator and, more particularly, to a smart refrigerator with a built-in smoothie maker which quickly provides a user with the desired drink of choice.

2. Description of the Related Art

Several designs for smart refrigerators have been designed in the past. None of them, however, include a smart refrigerator having touchscreen interfaces on the doors, and an integral, an automated smoothie maker comprising a door-mounted blender and juicer which is coupled to refrigerator storage that has automated dispensing means for providing the juicer and blender with ingredients as determined by the recipe programmed into the refrigerator, and where the automatic smoothie maker can be controlled remotely with a portable electronic device or automatically with a timer controlled system. Suitably, it may be possible for the automated smoothie maker to be voice controlled as well.

Applicant believes that a related reference corresponds to U.S. Pat. No. 9,279,611 for an intelligent refrigerator with a network communication module and a touchscreen that can be used for ordering and managing food inventory; the refrigerator can also communicate with remote clients such as a mobile device. Applicant believes that another related reference corresponds with U.S. Pat. No. 9,074,806 for a refrigerator with a display device and a graphic user interface that can display recipes based on the contents of the storage cabinet. None of these references, however, teach of a smart refrigerator with an automated smoothie maker housing a blender and juicer which are coupled to a refrigerator storage that has automated dispensing means for providing the juicer and blender with ingredients as determined by the recipe programmed into the refrigerator to provide the user with the selected drink of their choice.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a smart refrigerator that can facilitates the process of making juices or shakes for a user.

It is another object of the present invention to provide a smart refrigerator that automates the process of making juices or shakes for a user.

It is also another object of this invention to provide a smart refrigerator that helps facilitate the process of dieting for a user.

It is still another object of the present invention to provide a smart refrigerator that educates users on nutrients and benefits of various different food sources.

It is also another object of the present invention to provide a smart refrigerator includes preprogrammed or custom recipes.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
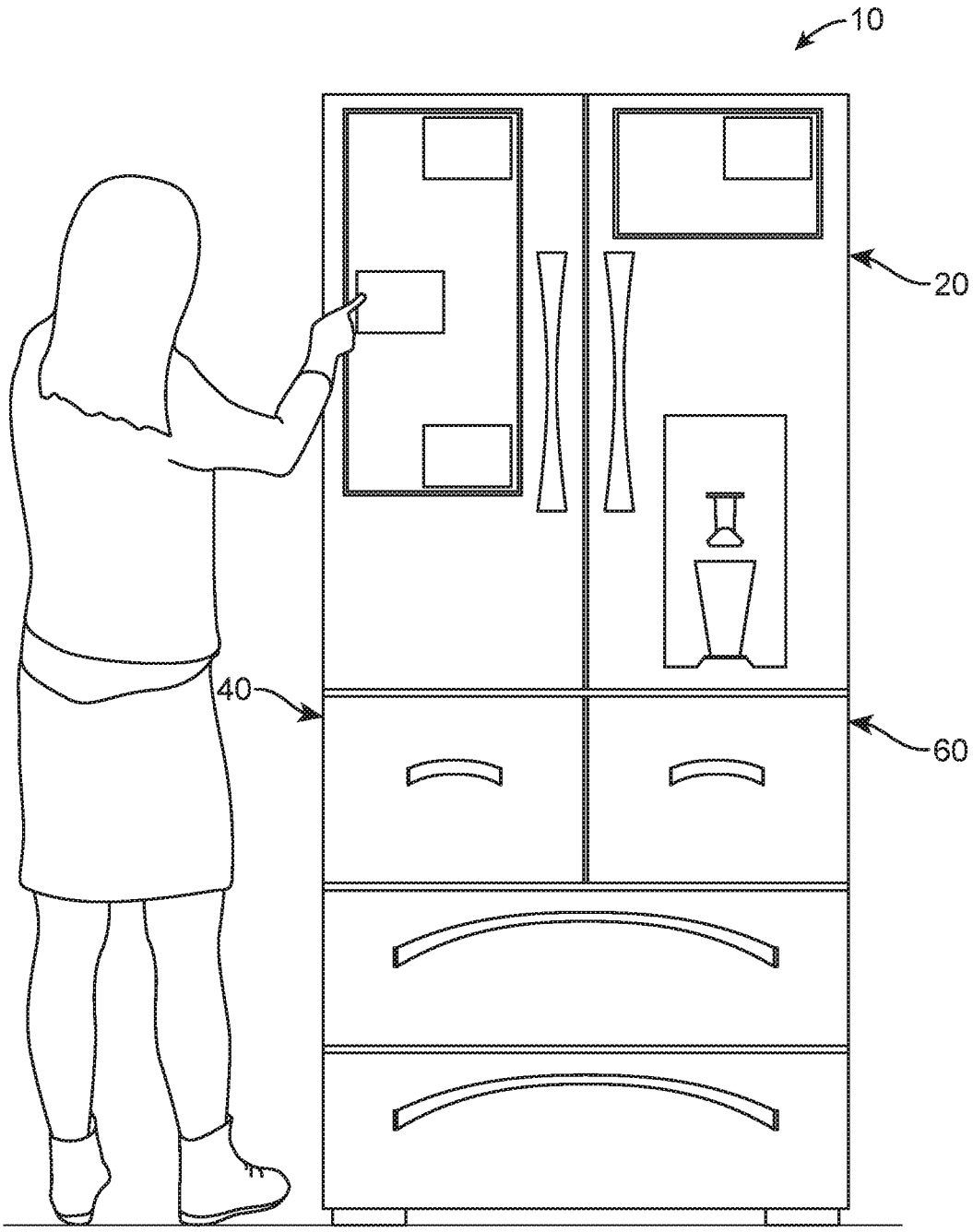
FIG. 1 represents an operational setting in which smart refrigerator 10 is being used and operated by a user.

Referring now to the drawings, where the present invention is generally referred to with numeral 10, it can be observed that it, basically includes refrigerator assembly 20, ice assembly 40, produce assembly 60, beverage mixer assembly 80 and suction assembly 100.

A smart refrigerator system 10 can help to facilitate the process of dieting and detoxing for users. Smart refrigerator system 10 can automate the process of making drinks as desired for users. It may be possible to make smoothies or juices for users with smart refrigerator system 10. Additionally, it may be possible to have the smart refrigerator system 10 on a set schedule to keep desire drinks readily available to the user. Smart refrigerator system 10 helps users improve their eating habits to lead to improved health overall.

Figure 2:
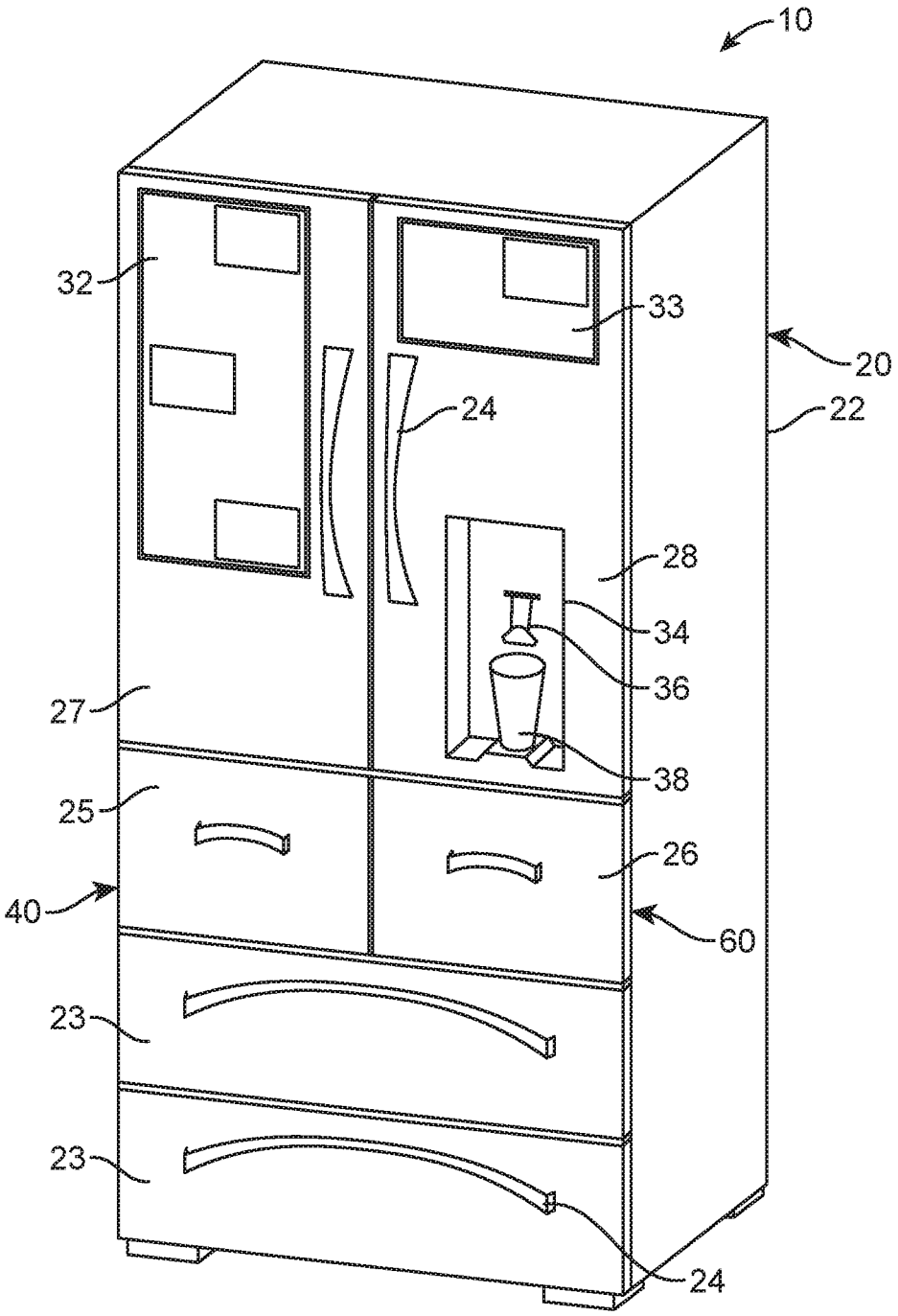
FIG. 2 an isometric view of the smart refrigerator 10 in a closed configuration.
Figure 3:
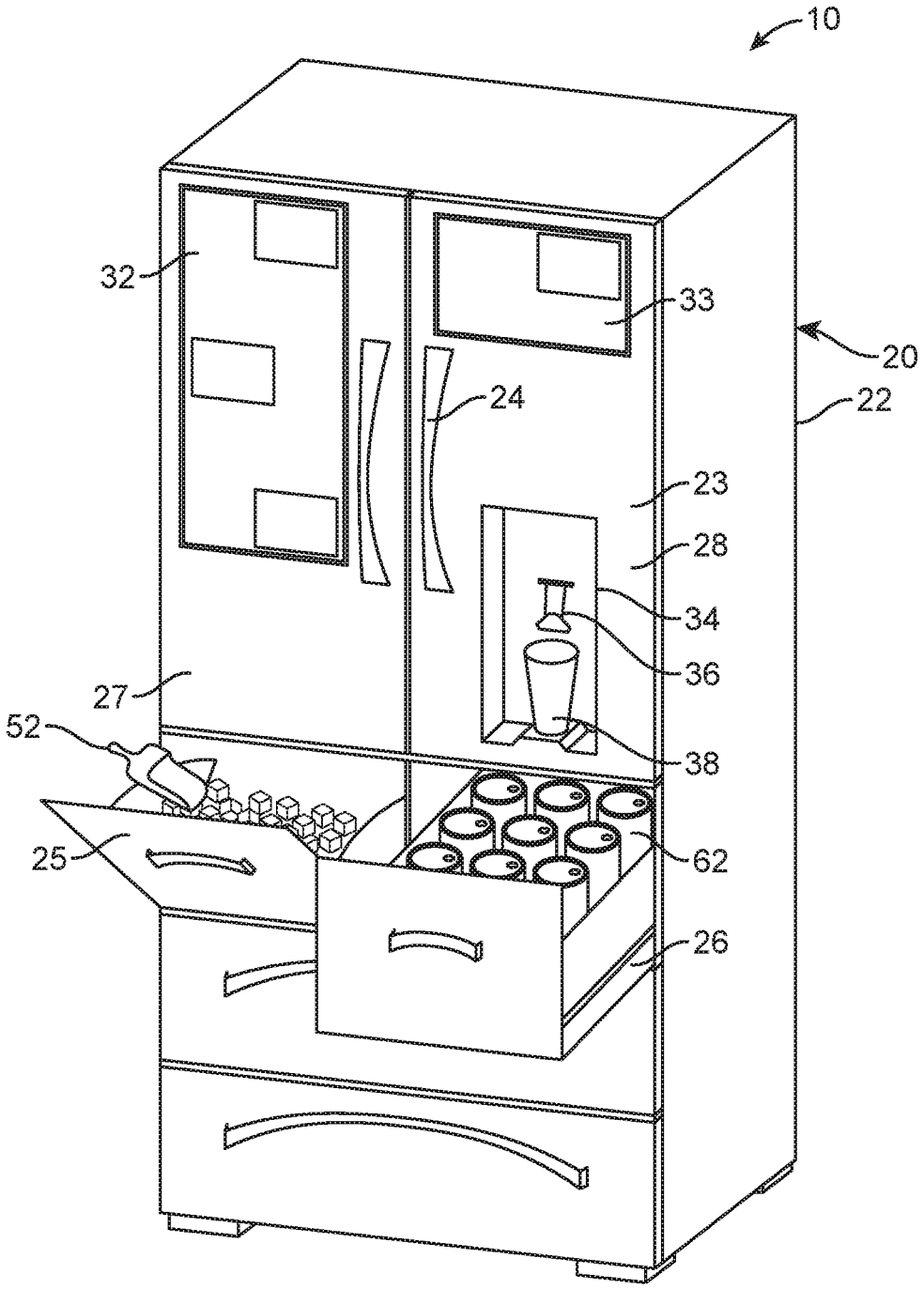
FIG. 3 shows an isometric view of smart refrigerator 10 with ice assembly 40 and produce assembly 60 opened.
Figure 4:
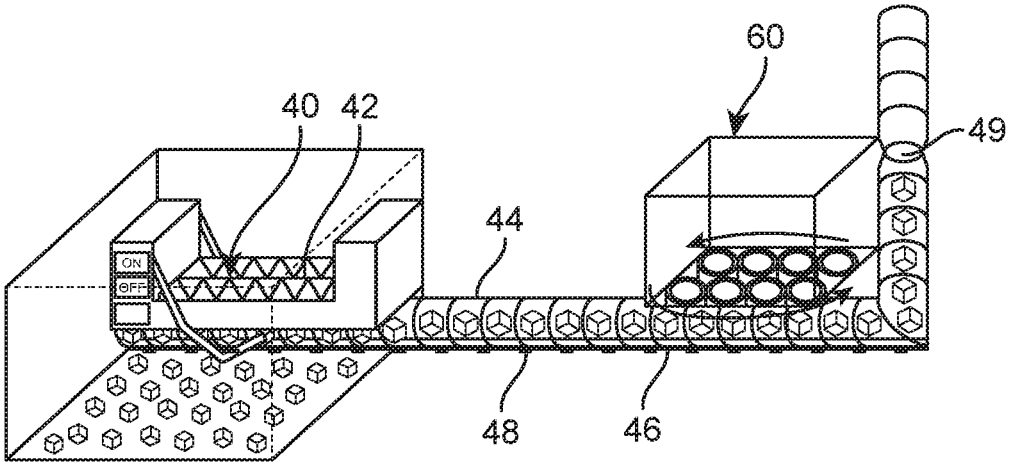
FIG. 4 illustrates ice assembly 40 and produce assembly 60.

Smart refrigerator 10, as best seen in FIGS. 1 and 2, may include refrigerator assembly 20. Refrigerator assembly 20 may include a refrigerator 22. Refrigerator 22 may be substantially rectangular in shape, in one embodiment. It may be suitable for refrigerator 22 to be of predetermined dimensions to fit into different locations such as homes and businesses. Refrigerator 22 may be made of materials such as plastic, stainless steel, metal, rubber, carbon fiber, aluminum, wood or combinations thereof. Refrigerator 22 may preferably have a height greater than a width. It is to be understood, refrigerator 22 may be equipped with means for cooling and freezing, as is standard in the art, to regulate and maintain temperatures within refrigerator 22 as needed by the user to prevent spoiling of the contents stored within refrigerator 22. In one embodiment, it may be suitable for refrigerator 22 to include feet at a bottom side thereof. Alternatively, refrigerator 22 may include wheels for ease of maneuvering refrigerator 22 about.

Refrigerator 22 may include storage compartments 23. It may be suitable for refrigerator 22 to include at least one of storage compartments 23. Storage compartments 23 may be able to maintain temperatures within a predetermined range, as known in the art of refrigerators, to prevent spoiling of the contents within storage compartments 23. It may be suitable for one of storage compartments 23 to be a freezer. In one embodiment, storage compartments 23 may slide outwardly from refrigerator 22 to permit access to an interior of storage compartments 23. Each of storage compartments 23 may include a handle 24 to facilitate opening and closing of each of storage compartments 23. Handle 24 on storage compartments 23 may extend horizontally and partially across. Preferably, storage compartments 23 may be arranged adjacently and vertically atop of each other. Storage compartments 23 may extend an entire width of refrigerator 22. Storage compartments 23 may be parallel to each other when both are open or closed.

It can be best seen in FIG. 2, that refrigerator assembly 20 may further include an ice compartment 25 and a produce compartment 26. Ice compartment 25 and produce compartment 26 may preferably be adjacent to each other. It may be suitable for ice compartment 25 and produce compartment 26 to be side by side. It can be seen that each of ice compartment 25 and produce compartment 26 may extend partially along the width of refrigerator 22. Ice compartment 25 may preferably house ice assembly 40 therein. Produce compartment 26 may preferably house produce assembly 60 therein. It is to be understood that, each of ice compartment 25 and produce compartment 26 may include handle 24 to open or close ice compartment 25 and produce compartment 26. Ice compartment 25 may have a hingedly mounted door. Produce compartment 26 may include a sliding door.

As best seen in FIG. 2, mounted above of ice compartment 25 and produce compartment 26 may be a first door 27 and a second door 28, respectively. First door 27 and second door 28 may be adjacent to each other. It may be preferred that first door 27 and second door 28 be hingedly mounted to refrigerator 22. Preferably, first door 27 and second door 28 may be mounted to the lateral sides of refrigerator 22. First door 27 and second door 28 may preferably be mounted vertically to refrigerator 22. Each of first door 27 and second door 28 may extend half the height of refrigerator 22, in one embodiment. Housed within refrigerator 22 behind second door 28 may preferably be smoothie maker assembly 60. Each of first door 27 and second door 28 may include handle 24. Handle 24 on first door 27 and second door 28 may extend vertically. Behind first door 27 may be additional storage for perishable goods within refrigerator 22.

Mounted onto first door 27 may be a first display 32. Mounted onto second door 28 may be a second display 33. First display 32 may extend partially along the height of first door 27. First display 27 and second display 33, in one embodiment, may have a rectangular shape. It is to be understood that first display 32 may be parallel to handle 24 on first door 27 and second door 28. Second display 33 may be perpendicular to handle 24 on second door 28. First display 32 and second display 33 may be perpendicular to each other. First display 32 may preferable extend vertically, while second display 33 may extend horizontally. Preferably, first display 32 and second display 33 may be touch screen. It may be suitable for first display 32 and second display 33 to be internet enabled, as such electrical connections with microcontrollers may be needed for first display 32 and second display 33, as known in the art. First display 32 and second display 33 may be voice activated and controlled. First display 32 may be able to display a calendar with appointment or meetings of the users. It may be possible to schedule beverage mixer assembly 80 through first display 32 for automatically producing desired drinks at a future time. Due to the internet capabilities of first display 32, it may be suitable to make produce orders and purchases through first display 32. It may be possible to track orders made through first display 32 on first display 32. First display 32 may also function as a notification center, where emails or messages from mobile devices may be displayed and responded to. It is to be understood that first display 32 and second display 33 may be communicate with each other. Second display 33 may be used to select the desired drink that the user would like from smart refrigerator 10. Second display 33 may have predetermined drink options for the use. Second display 33 may further be used to display videos showing the benefits of the various drinks available.

As best seen in FIG. 2, second door 28 may include a cavity 34 below second display 33. Cavity 34 may be partially recessed within second door 28. It can also be seen that extending downwardly within cavity 34 may be a chute 36. Chute 36 may preferably be tapered. Chute 36 may deliver drinks from smart refrigerator 10 to a beverage container 38. Beverage container 38 may be directly below chute 36. The user may remove beverage container 38 from cavity 34 to consume the prepared drink. If it is determined that beverage container 38 is not in place or is full then the prepared drink will not be dispensed.

Importantly, housed within ice compartment 25 may be ice assembly 40. Ice assembly 40 may produce ice cubes for the drinks that are to be prepared, whether juices or smoothies. Ice assembly 40 may include an ice maker 42. Ice maker 42 may produce ice cubes. In one embodiment, ice maker 42 may be substantially U shaped. Additionally, ice maker 42 may include on and off switches for turning on and off of ice maker 42. It may be suitable for the on and off switches to be located at both a front and a rear of ice maker 42. It may be suitable for ice maker 42 to be mounted atop of an ice tube 44. Ice tube 44 may help to guide ice cubes from ice maker 42 to beverage mixer assembly 80. Ice cubes from ice maker 42 may drop within ice tube 44. It is to be understood that ice tube 44 may be substantially cylindrical. Ice tube 44 may preferably extend from ice compartment 25 through produce compartment 26 and up to beverage mixer assembly 80. Within ice tube 44 may be a conveyor belt 46 to help move ice cubes produced by ice maker 42 along to beverage mixer assembly 80. It may be suitable for conveyor belt 46 to include magnets 48. Magnets 48 may help cause conveyor belt 46 to rotate to move ice cubes along within ice tube 44. Magnets 48 help to actuate conveyor belt 46 by acting as a micro electromechanical system magnetic actuator to cause a rotation of conveyor belt 46. Alternatively, conveyor belt 46 may be actuated by a motor. It is to be understand that other methods to rotate conveyor belt 46 may also be suitable. Excess ice cubes generated by ice maker 42 may instead be contained within ice compartment 25 instead of moving through ice tube 44. These excess ice cubes may be retrieved manually by the user as the user opens ice compartment 25 and used an ice scooper 52 to gather the needed ice cubes. It is to be understood that within ice tube 44 may be a flap 49. Flap 49 may be located at a predetermined area along ice tube 44. Flap 49 may prevent from ice cubes to travel backwards down ice tube 44. Flap 49 may allow for ice cubes to travel through to an upper portion of ice tube 44, but not rearwardly into a lower portion of ice tube 44.

It can be seen that inside of produce compartment 26 may be produce assembly 60. Produce assembly 60 may include produce containers 62. Produce containers 62 may be used to store and contain the necessary produce or ingredients for the desired beverages. Produce containers 62 may be adjacent to each other and extend vertically within produce compartment 26. In the preferred embodiment, produce containers 62 may be cylindrical in shape and substantially hollow when empty. It can be seen that produce containers 62 may be parallel to each other. It is to be understood that produce containers rotate in a circular motion within produce compartment 26. The rotation of produce containers 62 is to select the adequate ingredients needed for the selected beverage. To rotate produce containers 62 within produce compartment 26 may rest atop of a second conveyor belt to allow rotating of produce compartments 62 as needed. Mounted above of produce containers 62 may be a produce tube 64 that may be used to carry produce or ingredients from within produce containers 62 to beverage mixer assembly 80. It may be suitable for sensors to be within produce containers 62 to determine if produce or a foreign object is held within.

Figure 5:
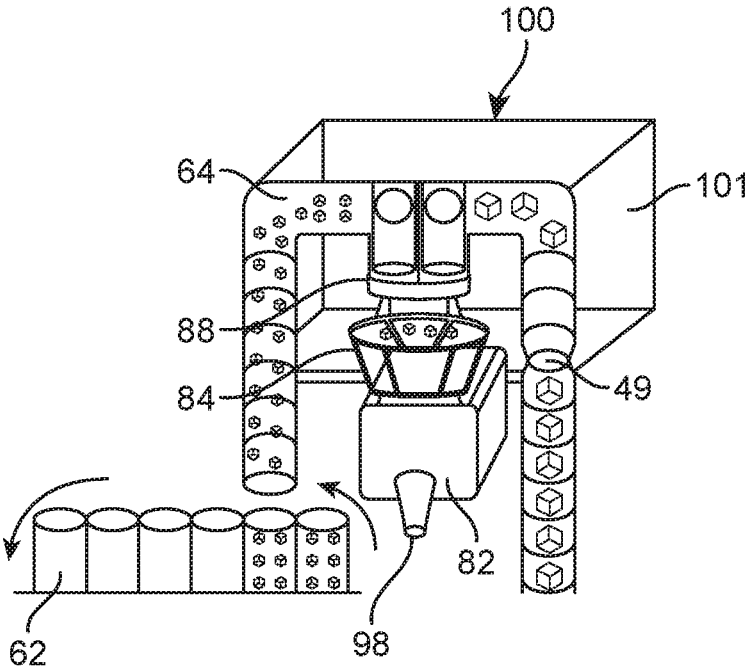
FIG. 5 is a representation of beverage mixer assembly 80.
Figure 6:
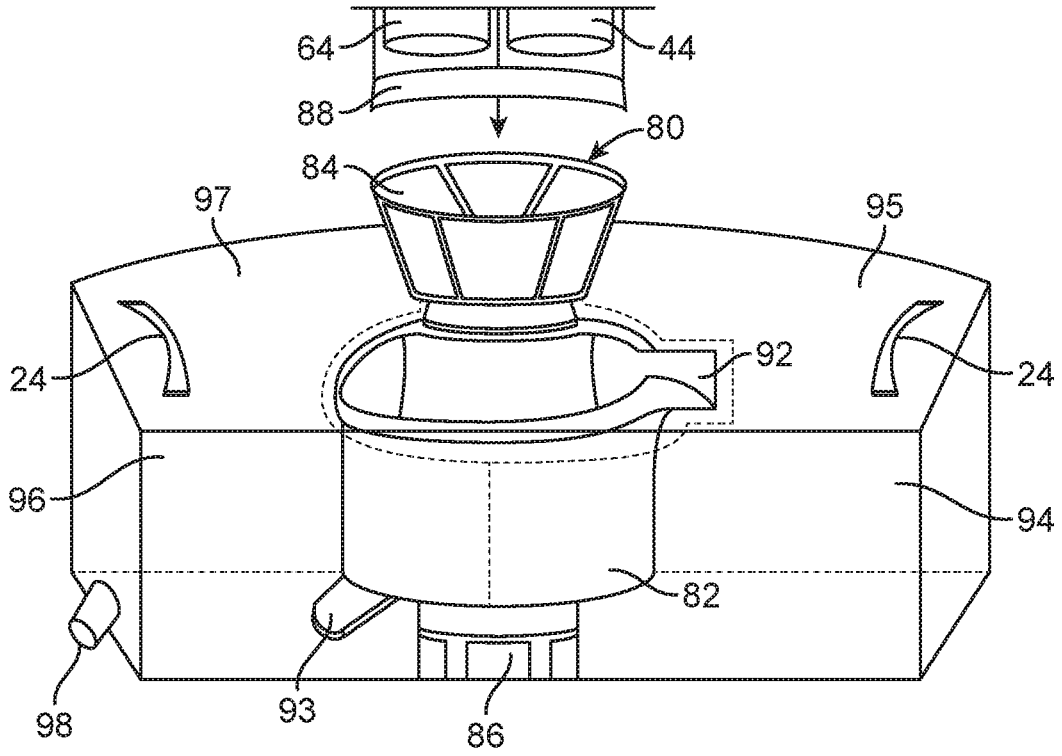
FIG. 6 represents a zoomed in view of beverage mixer assembly 80.
Figure 7:
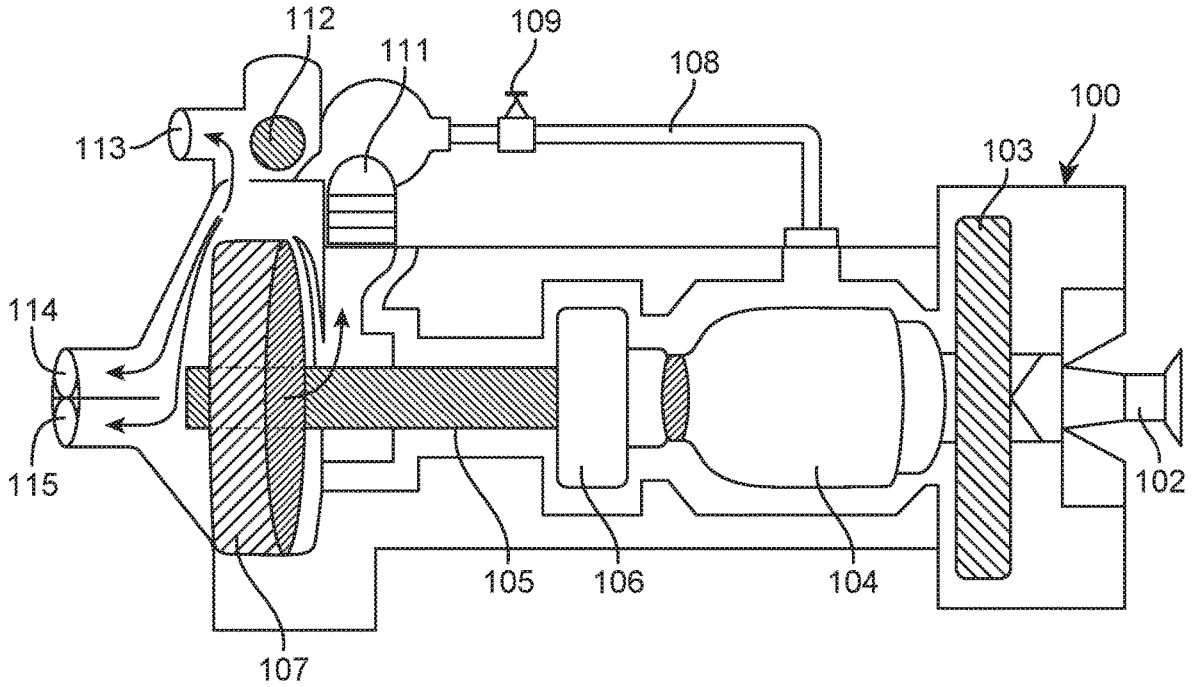
FIG. 7 shows a zoomed in view of the suction assembly 100.

Beverage mixer assembly 80 as best seen in FIGS. 5 and 6 processes the ice cubes and produce from ice compartment 25 and produce compartment 26, respectively. Beverage mixer assembly 80 may be integral with refrigerator 22 and be door mounted second door 28. Beverage mixer assembly 80 may be automated based on recipes programmed on refrigerator 22. It is to be understood that beverage mixer assembly 80 may be controlled locally at refrigerator 22 or remotely within a portable electronic device to produce desired beverages. Alternatively, beverage mixer assembly 80 may operate and function on a timer-controlled system. It can be seen that beverage mixer assembly 80 includes a mixer 82. Mixer 82 may blend and mix ice cubes and produce to generate the desired beverage of the user. Ice may be guided through ice tube 44 and produce may be guided through produce tube 64 to said mixer suction means. Beverage mixer assembly 80 may further include a strainer basket 84. Strainer basket 84 may include micro mesh blades for processing the ice cubes and produce received therein. Ice cubes may be delivered strainer basket 84 through ice tube 44. Produce may be delivered to strainer basket 84 through produce tube 64. Strainer basket 84 may be entirely received within mixer 82. Blending of products for the desired beverages occurs within strainer basket 84. Mounted underneath of mixer 82 may be a motor 86. Motor 86 may rotate strainer basket 84 to cause the blending of the contents stored within strainer basket 84. It is to be understood that when strainer basket 84 and motor 86 are actuated then a lid 88 is used to cover mixer 82. Lid 88 may selectively be removed from mixer 82 to allow ice cubes and produce to be inserted into strainer basket 84. Mixer 82 may further include a pulp spout 92. Pulp spout 92 may be located at near a top lateral side of mixer 82. It can be seen that in one embodiment, pulp spout 92 may be U shaped and elongated. Pulp spout 92 may extend outwardly and away from mixer 82. Pulp spout 92 may release pulp from mixer 82 after a beverage has been made. Mixer 82 may further include a juice spout 93. Juice spout 93 may be located at near a bottom lateral side of mixer 82. It can be seen that in one embodiment, juice spout 93 may be U shaped and elongated. Juice spout 93 may extend outwardly and away from mixer 82. Juice pulp may release juice or a beverage from mixer 82 after the ice cubes and produce are mixed and blended.

On lateral sides of mixer 82 may be a pulp container 94 and a juice container 96. Pulp container 94 may collect and store the pulp released by pulp spout 92. Juice container 96 may collect and store the liquids released by juice spout 93. It is to be understood that pulp container 94 and juice container 96 may have a substantially rectangular shape in one embodiment. It may be suitable for pulp container 94 to include a pulp container door 95. Pulp container door 95 may be opened or closed to permit or prevent access to the interior of pulp container 94 for cleaning or retrieving the contents within. It may be suitable for pulp container door 95 to include a door handle to facilitate opening and closing of pulp container door 95. It may be suitable for juice container 96 to include a juice container door 97. Juice container door 97 may be opened or closed to permit or prevent access to the interior of juice container 96 for cleaning or retrieving the contents within. It may be suitable for juice container door 97 to include a door handle to facilitate opening and closing of juice container door 97. Mounted to juice container 96 may be a pouring spout 98. Pouring spout 98 may release the contents of juice container 96 through chute 36 which then leads to beverage container 38. Thereby having a beverage ready for consumption by the user. It is to be understood that beverage mixer assembly operates automatically once actuated.

It is to be understood that to allow for ice assembly 40 and produce assembly 60 to deliver the needed ingredients to beverage mixer assembly 80, suction assembly 100 may be used. Suction assembly 100 may be interconnected to both of ice assembly 40 and produce assembly 60. Suction assembly 100 may be stored in a suction storage 101 that is behind beverage mixer assembly 80. Suction assembly 100 may include a suction pump 102 to create the needed suction to allow for items to travel through ice tube 44 and produce tube 64. To generate the needed power and energy for suction pump 102 to operate a first impeller 103, a first shaft portion 104, a second shaft portion 105, a ball bearing 106, a second impeller 107 may be attached to suction pump 102. First impeller 103, first shaft portion 104, second shaft portion 105, ball bearing and second impeller 107 may rotate to generate the needed power and energy for suction pump 102. Mounted to the first shaft portion 104 may be a pressure pipe 108 that may be used to make sure there is no issues with the power generated by the suction of suction pump 102 and rotation of first impeller 103, first shaft portion 104, second shaft portion 105, ball bearing and second impeller 107. Mounted onto pressure pipe 108 may be a pressure valve 109. It can be seen that beneath of pressure pipe 108 may be air suction valve 111. Suction valve 111 may be used to control the suction power of suction pump 102. Additionally, there may be a discharge valve ball 112 that helps to alleviate the pressure being released by pressure pipe 108 through a discharge mouth 113. There is also a first suction mouth 114 and a second suction mouth 115 that connect to ice tube 44 and produce tube 64, respectively to cause suction through ice tube 44 and produce tube 64.

Smart refrigerator 10 helps to provide ready to drink beverages to users in a manner that is quick and convenient. It may be suitable to use smart refrigerator 10 to assists users in diets, in some instances. The added convenience of the present invention may help users to be more consistent with their diets for improved health.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a smart refrigerator, comprising:

a) a refrigerator assembly including a refrigerator, said refrigerator including a first door and a second door, said first door having a first display mounted thereto, said second door having a second display mounted thereto, said first display and said second display being touchscreens, said refrigerator including an ice compartment and a produce compartment, said second door including a cavity, said cavity being below said second display, said cavity including a chute;

b) an ice assembly including an ice maker, said ice maker stored within said ice compartment;

c) a produce assembly including produce containers, said produce containers stored within said produce compartment;

d) a beverage mixer assembly including a mixer, said mixer adapted to receiving ice from said ice maker and produce from said produce containers, said mixer dispensing beverages through said chute and into a beverage container, said beverage container being beneath said chute; and e) a suction assembly including a suction pump to allow for said ice and said produce to be delivered to said mixer, said mixer blending said ice and said produce to dispense a desired drink for a user.

2. The system of claim 1, wherein said refrigerator includes storage compartments beneath said ice compartment and said produce compartment, said storage compartments being adjacent and parallel to each other.

3. The system of claim 2, wherein said storage compartments, said ice compartment, said produce compartment, said first door and said second door each including a handle mounted thereto, said handle on said storage compartments, said ice compartment and said produce compartment extending horizontally, said handle on said first door and said second door extending vertically.

4. The system of claim 3, wherein said first display extends vertically on said first door and said second display extends horizontally on said second door.

5. The system of claim 1, wherein said ice assembly includes an ice tube, said ice tube being below said ice maker, said ice from said ice maker being dispensed within said ice tube, said ice being guided to said mixer through said ice tube, said ice tube including a flap, said flap preventing said ice from falling downwardly along said ice tube.

6. The system of claim 5, wherein said ice assembly further includes a conveyor belt within said ice tube, said conveyor belt having magnets thereon, said magnets causing said conveyor belt to rotate within said ice tube.

7. The system of claim 1, wherein said ice assembly includes an ice scooper within said ice compartment to retrieve said ice manually.

8. The system of claim 1, wherein said produce assembly further includes a produce tube to guide said produce from said produce containers.

9. The system of claim 1, wherein said mixer includes a strainer basket therein, said strainer basket receiving said ice and said produce.

10. The system of claim 9, wherein said beverage mixer assembly includes a motor, said motor being below said mixer and causing said strainer basket to rotate for blending the contents therein.

11. The system of claim 1, wherein said mixer includes a lid, said lid maintaining said ice and said produce within said mixer during blending.

12. The system of claim 1, wherein said mixer includes a pulp spout and a juice spout, said pulp spout being mounted at a top lateral side of said mixer, said juice spout being mounted at a lower lateral side of said mixer, said pulp spout and said juice spout being on opposite lateral sides of said mixer, said pulp spout and said juice spout extending outwardly and away from said mixer.

13. The system of claim 12, wherein said pulp spout leads to a pulp container, said pulp container including a pulp container door that can be selectively opened for access to an interior of said pulp container, said pulp container being adjacent to said mixer, said pulp spout being entirely housed within said pulp container.

14. The system of claim 12, wherein said juice spout leads to a juice container, said juice container including a juice container door that can be selectively opened for access to an interior of said juice container, said juice container being adjacent to said mixer, said juice spout being entirely housed within said juice container.

15. The system of claim 14, wherein said beverage mixer includes a pouring spout, said pouring spout mounted to an exterior of said juice container, said pouring spout dispensing the contents of said juice container.

16. The system of claim 1, wherein said mixer is controlled locally, remotely with a portable electronic device or automatically with a timer-controlled system.

17. The system of claim 1, wherein said suction assembly includes a suction storage, said suction storage being behind said beverage mixer assembly.

18. The system of claim 1, wherein said suction assembly further includes a first impeller, a first shaft portion, a second shaft portion, a ball bearing and a second impeller, said first shaft portion, said second shaft portion, said ball bearing and said second impeller generating sufficient power for said suction pump, a pressure pipe mounted above of said first shaft portion adapted to alleviate pressure generated by said suction pump, a pressure valve mounted onto said pressure pipe to control pressure, an air suction valve mounted underneath of said air pressure pipe, said air suction valve controlling the suction power of said suction pump, a discharge valve ball that slows the pressure released, a discharge mouth through which the pressure is released.

19. The system of claim 1, wherein said suction assembly further includes a first suction mouth and a second suction mouth, said first suction mouth connected to said ice assembly and said second suction mouth connected to said produce assembly to suction said ice and said produce to be delivered to said mixer.

* * * * *